US005202050A

United States Patent [19]

Culshaw et al.

[11] Patent Number: 5,202,050

[45] Date of Patent: Apr. 13, 1993

[54] METHOD FOR CLEANING HARD-SURFACES USING A COMPOSITION CONTAINING ORGANIC SOLVENT AND POLYCARBOXYLATED CHELATING AGENT

[75] Inventors: Stephen Culshaw, Meise; Eddy Vos, Linden, both of Belgium

[73] Assignee: The Procter & Gamble Company, Cincinnati, Ohio

[21] Appl. No.: 587,477

[22] Filed: Sep. 19, 1990

Related U.S. Application Data

[63] Continuation of Ser. No. 285,337, Dec. 14, 1988, abandoned, which is a continuation of Ser. No. 177,708, Apr. 5, 1988, abandoned.

[30] Foreign Application Priority Data

Apr. 6, 1987 [GB] United Kingdom ..... 8708151
Apr. 23, 1987 [GB] United Kingdom ..... 8709621

[51] Int. Cl.[5] ..... C11D 7/26; C11D 7/50

[52] U.S. Cl. ..... 252/170; 252/162; 252/163; 252/164; 252/165; 252/166; 252/174.19; 252/DIG. 14

[58] Field of Search ..... 252/162, 163, 164, 165, 252/166, 170, 174.19, DIG. 14

[56] References Cited

U.S. PATENT DOCUMENTS 3,580,852 5/1971 Yang ..... 252/135
3,591,510 7/1971 Zenk ..... 252/137
3,635,830 1/1972 Lamberti et al. ..... 252/152
3,692,685 9/1972 Lamberti et al. ..... 252/89
3,812,044 5/1974 Connor et al. ..... 252/89
3,865,755 2/1975 Lannert ..... 252/558
3,882,038 5/1975 Clayton et al. ..... 252/158
3,898,034 8/1975 Szymanski et al. ..... 252/174.19
3,912,765 10/1975 Shen ..... 252/174.19
3,923,679 12/1975 Rapko ..... 252/89
4,092,348 5/1978 Crutchfield et al. ..... 252/174.19
4,100,358 11/1978 Lannert ..... 252/174.19
4,102,903 7/1978 Crutchfield et al. ..... 252/174.19
4,107,064 8/1978 Nelson et al. ..... 252/89
4,182,900 1/1980 Crutchfield et al. ..... 252/132
4,485,028 11/1984 King ..... 252/99
4,627,931 12/1984 Malik ..... 252/170
4,663,071 5/1987 Bush et al. ..... 252/174.19
4,781,856 11/1988 Ouhadi et al. ..... 252/174.19
4,810,421 3/1989 Marchesini ..... 252/174.19
5,061,393 10/1991 Linares et al. ..... 252/170

FOREIGN PATENT DOCUMENTS 040882 12/1981 European Pat. Off. .
080749 6/1983 European Pat. Off. .
0105063 4/1984 European Pat. Off. .
126545 11/1984 European Pat. Off. .
2150326 4/1972 Fed. Rep. of Germany .

*Primary Examiner*—Prince Willis, Jr.
*Assistant Examiner*—Bradley A. Swope
*Attorney, Agent, or Firm*—Robert B. Aylor

[57] ABSTRACT

Safe and effective hard-surface cleaning compositions are disclosed, which contain a binary mixture of an organic solvent and a narrowly defined chelating agent.

10 Claims, No Drawings

METHOD FOR CLEANING HARD-SURFACES USING A COMPOSITION CONTAINING ORGANIC SOLVENT AND POLYCARBOXYLATED CHELATING AGENT

This is a continuation of application Ser. No. 285,337, filed Dec. 14, 1988, now abandoned, which is a continuation of application Ser. No. 177,708, filed Apr. 5, 1988, now abandoned.

TECHNICAL FIELD

The present invention relates to hard-surface cleaning compositions containing a binary mixture of an organic solvent and a narrowly defined organic chelating agent.

BACKGROUND OF THE INVENTION

It is well known to formulate hard-surface cleaning compositions, containing organic solvents and chelating agents.

European Patent Applications 0 048 882, 0 080 749, 0 126 545 describe the use of solvents represented by mixtures of terpenes with benzyl alcohol or butyl carbitol, together with builders which are mainly polyphosphates, or nitrogen containing strong sequestrants like NTA.

EP 0 105 863 and U.S. Pat. No. 3,591,510 describe the use of certain glycol ether derivatives as solvents in liquid cleansers, together with polyphosphate builders.

The above solvent/builder combinations have proven very effective; however, in recent years phosphates have come under scrutiny for environmental reasons, and other non-phosphate strong sequestering agents are also facing acceptability problems related to toxicity/environmental safety.

There is therefore a need for hard-surface-cleaning compositions which are effective and at the same time are not likely to raise safety concerns with regard to toxicology and environment.

The present invention is based on the discovery that certain known chelating agents, when combined with a specific class of organic solvents, provide very good results in terms of soil-removal from hard surfaces, because of unexpected and beneficial chelant/solvent interaction, said known chelating agents being safe compounds constituted solely of carbon, hydrogen, and oxygen.

Carboxymethyltartronic acid has been described as detergency builder in U.S. Pat. No. 3,865,755, and in DE-OS-2 549 741.

Oxydisuccinic acid and carboxymethyloxysuccinic acid are known in the same functionality, from U.S. Pat. No. 3,635,830, and 3,692,685.

Tetrahydrofuran tetracarboxylic acid is known as phosphate replacement builder from U.S. Pat. No. 3,580,852.

Diglycolic acid is known as sequestering agent in detergent compositions, from DE-OS 2 150 325.

All above materials have not found great success as phosphate builder replacement in laundry detergent compositions, since their sequestering power has been considered as too weak.

None of the above detergent compositons encompass hard-surface cleaning compositions, and there has been no disclosure of the chelating agents described herein, in combination with organic solvents according to the present invention.

It has now been surprisingly discovered that the combination of the chelating agents herein with certain organic solvent provide very good results in terms of soil removal from hard surfaces.

It is therefore the object of the present invention to provide efficient hard surface cleaning compositions containing the combination of a safe chelating agent, and a suitable organic solvent.

SUMMARY OF THE INVENTION

The invention relates to hard-surface cleaning compositions containing a binary mixture of organic solvent having a boiling point equal to or above 90° C., and an organic chelating agent containing neither phosphorous nor nitrogen, such chelating agents being selected from compounds having the formulae (I) to (VII) hereinafter described, or mixtures of compounds (I) to (VII).

DETAILED DESCRIPTION OF THE INVENTION

The Non-phosphorous Chelating Agent

The chelating agents for use in the present invention are hydrocarbon compounds which do not contain phosphorous or nitrogen, and where the chelating ability is provided by carboxylate groups.

Although such chelating agents are not considered as strong builders by detergent manufacturers, especially in comparison with phosphate builders, it has been surprisingly discovered that their combination with certain organic solvents leads to excellent soil removal action from hard surfaces.

The chelating agents which can be used in the context of the present invention are selected from the group of:

compounds of the formula (I)

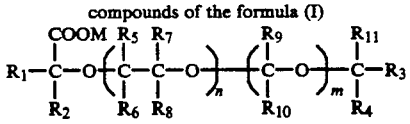

wherein $R_1$ to $R_{11}$ are selected independently from the group of: H, COOM, $CH_3$, $CH_2CH_3$, $CH_2COOM$, $CH_2OH$, CH(OH)COOM, $C_3H_7$, OH;

n is 0 or an integer from 1 to 3; and m is 0 or an integer from 1 to 4.

compounds of the formula (II)

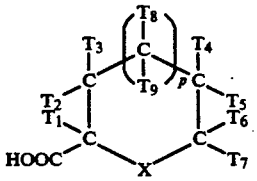

wherein

X is —O— or —$CH_2$—

$T_1$ to $T_9$ are selected independently from the group of: H, COOM, $CH_3$, $CH_2CH_3$, $CH_2COOM$, $CH_2OH$, OH; and p is 0, 1, or 2.

compounds of the formula (III)

-continued

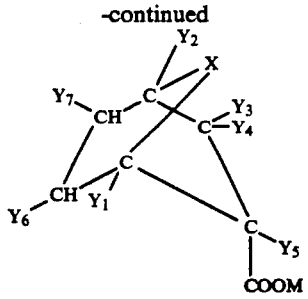

wherein

X is —O— or —$CH_2$ $Y_1$ to $Y_7$ are selected independently from the group of: H, COOM, $CH_3$, $CH_2COOM$, $CH_2OH$, OH;

compounds of formula (IV)

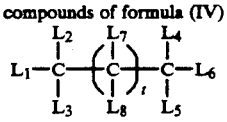

wherein $L_1$ to $L_8$ are selected independently from the group of: H, COOM, $CH_3$, $CH_2COOM$, $CH_2OH$, OH, $OCH_2COOM$, $OCH(COOM)_2$;

t is 0 or an integer from 1 to 8;

with the proviso that when t is 1, $L_6$ and $L_7$ are selected from H, OH, $CH_3$, $CH_2COOM$, $CH_2OH$, $OCH_2$-COOM, $OCH(COOM)_2$.

compound of formula (V)

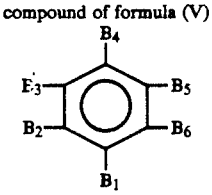

wherein $B_1$ to $B_6$ are selected from the group of H, COOM, $CH_3$, $CH_2CH_3$, $CH_2COOM$, $CH_2OH$, OH, $CH_2OCH_2COOM$ $CH_2OCH(COOM)_2$, $CH_2OCH_3$, $CH_2OCH(OH)COOM$, compound of formula VI

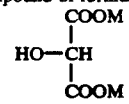

or formula VII

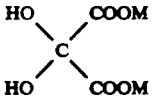

In formulas I to VII, M is H or an alkalimetal ion such as Na or K.

The compounds of formula (I) preferably contain at least two carboxylate groups. m and n are preferably 0 or 1. Most preferably, n and m are zero in formula (I), and such category includes oxydiacetic acid ($R_1$ to $R_4$ are hydrogen, $R_{11}$ is —COOH), carboxymethyltartronic acid ($R_1$, $R_2$, $R_3$ are H, $R_4$ and $R_{11}$ are —COOH), oxydimalonic acid ($R_1$, $R_4$ and $R_{11}$ are COOH), carboxymethyloxysuccinic acid ($R_1$, $R_2$, $R_3$ are hydrogen, $R_4$ is $CH_2COOH$, $R_{11}$ is —COOH), tartrate monosuccinic acid ($R_1$ is H, $R_2$ is CH(OH)COOH, $R_4$ is $CH_2COOM$, $R_{11}$ is —COOH, $R_3$ is H), oxydisuccinic acid ($R_1$ and $R_3$ are H and $R_2$ and $R_4$ are $CH_2COOH$ $R_{11}$ is —COOH). When n=1 and m=0, tartrate disuccinic acid ($R_1$, $R_3$, $R_5$, $R_7$ are H, $R_2$ and $R_4$ are —$CH_2COOH$, $R_6$, $R_8$ and $R_{11}$ are —COOH) and Ethylene glycol dimalonate ($R_1$, $R_3$, $R_5$, $R_6$, $R_7$, $R_8$ are H, $R_2$, $R_3$ and $R_{11}$ are —COOH) are suitable compounds.

Also preferred is a mixture of tartrate monosuccinic acid and tartrate disuccinic acid, preferably in a weight ratio of monosuccinic to disuccinic of 70:30 to 90:10.

In compounds of formula (II), p is preferably O and $T_7$ preferably —COOM; such compounds include derivatives of tetrahydrofuran, when X is oxygen, and substituted cyclopentane, when X is —$CH_2$—.

Derivatives of tetrahydrofuran are particularly represented by tetrahydrofurandicarboxylic acid ($T_1$ to $T_6$ are H), tetrahydrofurantetracarboxylic acid ($T_2$ and $T_4$ are —COOM, $T_1$, $T_3$, $T_5$, $T_6$ are H). Another alternative is represented by tetrahydrofurantetracarboxylic acids wherein $T_1$ and $T_6$ are —COOM, and $T_2$ to $T_5$ are H.

Suitable substituted cyclopentanes include cyclopentane tetracarboxylic acid ($T_2$ and $T_4$ are —COOM, $T_1$, $T_3$, $T_5$, $T_6$ are H).

The compounds of formula (III)-Such chelating agents include 2-oxa-bicyclo(2.2.1) heptane (1,4,5) tricarboxylic acid, 2-oxa-bicyclo(2.2.1) heptane (4,5,6) tricarboxylic acid.

The compounds of formula (IV)-When t is zero, suitable species include tartaric acid, ($L_1$ and $L_6$ are OH, $L_2$ and $L_4$ are H, $L_3$ and $L_5$ are —COOM); when t=1, derivatives of glycerol with $L_3$, $L_8$, $L_5$ selected from O—$CH_2COOM$ and O—$CH(COOM)_2$ are suitable.

The compounds of formula (V) contain at least a carboxy group, either directly attached to the benzene ring, or comprised in an alkyl substituent of said benzene ring. A preferred species is represented by mellitic acid, wherein $B_1$ to $B_6$ are COOM.

The chelating agents of the invention are present at levels of from 1% to 20% of the total composition, preferably 2% to 10%.

The compounds of formula (VI) and (VII) are hydroxypropanedioic acid and dihydroxypropanedioic acid.

The Organic Solvent

It has been found that the organic solvents suitable for use in combination with the above-described chelating agents must have a boiling point equal to or above 90° C., in order to give the unexpected soil-release benefits derivable from the solvent-chelating agent combination.

For instance, $C_1$–$C_3$ aliphatic alcohols like isopropanol (B.P. 82° C.) are not suitable for use in the present invention.

Representatives of organic solvents which are effective in the present context are: $C_6$–$C_9$ alkyl aromatic solvents, especially the $C_6$–$C_9$ alkyl benzenes, alpha-olefins, like 1-decene or 1-dodecene, benzyl alcohol, n-hexanol, phthalic acid esters.

A type of solvent especially suitable for the compositions herein comprises diols having from 6 to 16, preferably 8 to 12, carbon atoms in their molecular structure. Preferred diol solvents have a solubility in water of from about 0.1 to about 20 g/100 g of water at 20° C.

The most preferred diol solvents are 2,2,4-trimethyl-1,3-pentanediol, and 2-ethyl-1,3-hexanediol.

Glycol ethers are another class of particularly preferred solvents.

In this category, are: water-soluble CARBITOL ® solvents or water-soluble CELLOSOLVE ® solvents. Water-soluble CARBITOL ® solvents are compounds of the 2-(2-alkoxyethoxy)ethanol class wherein the alkoxy group is derived from ethyl, propyl, butyl pentyl hexyl; a preferred water-soluble carbitol is 2-(2-butoxyethoxy)ethanol also known as butyl carbitol. Preferred are also hexyl carbitol and 2-methyl pentyl carbitol. Water-soluble CELLOSOLVE ® solvents are compounds of the 2-alkoxyethoxy ethanol class, wherein the alkoxy group is preferably butyl or hexyl.

Still in the glycol ether category, certain propyleneglycol derivatives have been found to be particularly efficient in the present context; these species include 1-n-butoxypropane-2-ol, and 1(2-n-butoxy-1-methylethoxy)propane-2-ol (butoxypropoxypropanol), with the latter being especially preferred.

Mixtures of the above solvents can also be used, like Butyl carbitol and/or Benzyl alcohol together with diols and/or glycol ethers.

The organic solvent is present at level of from 1% to 20% by weight of the total composition, preferably from 1% to 10%.

Chelating Agent/Solvent Combination

The benefits of the present compositions are derived from the combination of the specific organic chelating agents and organic solvents described hereinabove.

They are particularly noticeable in terms of calcium soap-soil removal from surfaces such as bathtub surfaces.

In order to obtain such an effect, the weight ratio or organic solvent to chelating agent is in the range from 2/3 to 2/1, preferably 1/1 to 2/1.

Combinations of e.g. the preferred chelating agents of formula (I) with 2-(2-butoxy-1-methylethoxy)propanol, or with 2,2,4-trimethyl-1,3-pentane diol in a ratio in the preferred 1/1 to 2/1 range have been found to be particularly effective.

Optional Ingredients

In addition to the essential chelating agent/solvent binary mixture described hereinabove, the compositions of the invention can contain additional ingredients, which are often highly desirable.

The compositions herein will usually contain a surface-active agent.

Water-soluble detersive surfactants useful herein include well-known synthetic anionic, nonionic, cationic, amphoteric and zwitterionic surfactants and mixtures thereof. Typical of these are the alkyl benzene sulfates and sulfonates, paraffin sulfonates, olefin sulfonates, alkoxylated (especially ethoxylated) alcohols and alkyl phenols, amine oxides, sulfonates of fatty acids and of fatty acid esters, and the like, which are well-known in the detergency art. In general, such detersive surfactants contain an alkyl group in the $C_{10}$–$C_{18}$ range; the anionic detersive surfactants are most commonly used in the form of their sodium, potassium or triethanolammonium salts. The nonionics generally contain from 3 to 17 ethylene oxide groups per mole of hydrophobic moiety. Cationic surfactants will generally be represented by quaternary ammonium compounds such as ditallow dimethyl ammonium chloride, and will be preferably used in combination with nonionic surfactants.

Especially preferred in the compositions of the present invention are: $C_{12}$–$C_{16}$ alkyl benzene sulfonates, $C_{12}$–$C_{18}$ paraffin-sulfonates and the ethoxylated alcohols of the formula $RO(CH_2CH_2O)_n$, with R being a $C_{12}$–$C_{15}$ alkyl chain and n being a number from 6 to 10 and $C_{12}$–$C_{18}$ ethoxylated alcohol sulfates of formula $RO—(CH_2CH_2O)_n—SO_3M$.

Anionic surfactants are frequently present at levels from 0.3% to 8% of the composition. Nonionic surfactants, are used at levels between 0.1% to 6% by weight of the composition. Mixtures of the like surfactants can also be used.

Other optional ingredients are represented by conventional detergency builders, which may be used in addition to the chelating agent herein; compounds classifiable and well-known in the art as detergent builders include the nitrilotriacetates (NTA), polycarboxylates, citrates, water-soluble phosphates such as tri-polyphosphate and sodium ortho- and pyro-phosphates, silicates, ethylene diamine tetraacetate (EDTA), amino-polyphosphonates (DEQUEST), phosphates and mixtures thereof.

Highly desirable ingredients for use herein are represented by conventional detergent hydrotropes. Examples of suitable hydrotropes are urea, monoethanolamine, diethanolamine, triethanolamine and the sodium potassium, ammonium and alkanol ammonium salts of xylene-, toluene-, ethylbenzene- and isopropyl-benzene sulfonates.

The hard-surface cleaning compositions of the invention may also contain an abrasive material.

The abrasives suitable herein are selected from water-insoluble, non-gritty materials well-known in the literature for their relatively mild abrasive properties. It is highly preferred that the abrasives used herein not be undesirably "scratchy". Abrasive materials having a Mohs hardness in the range of about 7, or below, are typically used; abrasives having a Mohs hardness of 3, or below, can be used to avoid scratches on aluminum or stainless steel finishes. Suitable abrasives herein include inorganic materials, especially such materials as calcium carbonate and diatomaceous earth, as well as materials such as Fuller's earth, magnesium carbonate, China clay, attapulgite, calcium hydroxyapatite, calcium orthophosphate, dolomite and the like. The aforesaid inorganic materials can be qualified as "strong abrasives". Organic abrasives such as urea-formaldehyde, methyl methacrylate melamine-formaldehyde resins, polyethylene spheres and polyvinylchloride can be advantageously used in order to avoid scratching on certain surfaces, especially plastic surfaces.

Typically, abrasives have a particle size range of 10–1000 microns and are used at concentrations of 5% to 30% in the compositions. Thickeners are frequently added to suspend the abrasives.

Thickeners will preferably be included in the compositions of the inventions, mainly in order to suspend the abrasive; high levels of thickener are detrimental to the performance because they are difficult to rinse from the cleaned surfaces. Accordingly, the level will be kept under 2%, preferably from 0.2% to 1.5%. Common thickeners such as the polyacrylates, xanthan gums, carboxymethyl celluloses, swellable smectite clays, and the like, can be used herein.

Soaps can be included in the compositions herein, the soaps prepared from coconut oil fatty acids being preferred.

Optional components are also represented by ingredients typically used in commercial products to provide aesthetic or additional product performance benefits. Typical ingredients include perfumes, dyes, optical brighteners, soil suspending agents, detersive enzymes, gel-control agents, thickeners, freeze-thaw stabilizers, bactericides, preservatives, and the like.

Preferred Executions of the Compositions

The hard-surface cleaning compositions herein will advantageously be executed in the form of an aqueous liquid compositions, including concentrates, containing as essential ingredients a surface-active agent, and the solvent/chelating agent binary mixture according to the invention.

Liquid executions at normal dilution usually contain 2–6% surfactant and 8–12% solvent/chelating agent binary mixture.

Concentrated liquid executions usually contain 6–10% surfactant and 16–24% solvent/chelating agent binary mixture.

Alternatively, the compositions herein will be in the form of a creamy scouring cleanser, containing an abrasive material, surface-active agent, and the solvent/-chelating agent binary mixture of the invention.

In both executions, the pH of such compositions will be neutral or in the alkaline range, generally in the range of pH 5–11.

The following examples are given by way of illustrating the compositions herein, but are not intended to be limiting of the scope of the invention.

| Abbreviations | |
|---|---|
| NaPS | Sodium $C_{13}$ to $C_{16}$ paraffin sulfonate |
| LAS | Sodium salt of linear $C_{11}$–$C_8$ alkyl benzene sulfonate |
| Lutensol ® $AO_7$ | Condensate of 1 mole $C_{12}$–$C_{14}$ fatty alcohol with 7 moles of ethylene oxide |
| Lutensol ® $AO_3$ | Condensate of 1 mole $C_{12}$–$C_{14}$ fatty alcohol with 3 moles of ethylene oxide |
| Neodol 25E3S | Sulfated condensate of 1 mole $C_{12}$–$C_{15}$ fatty alcohol with 3 moles of ethylene oxide |
| HCnFA | Narrow cut, hardened, coconut fatty acid |
| ETHD | 2-Ethyl-1,3-hexanediol |
| BPP | Butoxy Propoxy Propanol-1(2-n-butoxy-1-methylethoxy)propane-2-ol |
| NaCS | Sodium cumene sulfonate |
| CMTA | Carboxymethyltartronic acid |
| CMOS | Carboxymethyloxysuccinic acid |
| THFTA | Tetrahydrofurantetracarboxylic acid |
| CPTA | Cyclopentanetetracarboxylic acid |
| OBHTA | 2 Oxa-bicyclo (2.2.1) heptane (1.4.5.) tricarboxylic acid |
| TSA/TDSA | tartrate monosuccinic acid/tartrate disuccinic acid blend, at 80:20 weight ratio |
| ODS | Oxydisuccinic acid |
| Sokolan ® PHC25 | Crosslinked polyacrylate thickener |

The following liquid hard surface cleaning compositions according to the invention are prepared.

Examples III and V are concentrates, in accordance with one execution of the present invention.

| | percent by weight | | | | | | | | | | | | | |
|---|---|---|---|---|---|---|---|---|---|---|---|---|---|---|
| Ingredients | Ex I | Ex II | Ex III | Ex IV | Ex V | Ex VI | Ex VII | Ex VIII | Ex IX | Ex X | Ex XI | Ex XII | Ex XIII | Ex XIV |
| LAS | — | — | — | 4 | — | 3.0 | — | 0.5 | 0.5 | — | 2.5 | — | — | — |
| NaPS | 3 | 2.5 | 6.0 | — | 6.0 | 1.0 | 4.0 | 3.0 | 3.0 | 4.0 | — | 2.0 | 2.0 | 2.0 |
| Lutensol $AO_7$ | — | — | 2.0 | — | 2.0 | — | 0.2 | 0.2 | 0.2 | 0.2 | — | — | — | — |
| Lutensol $AO_3$ | 0.6 | 1.0 | — | — | — | 0.2 | — | — | — | — | — | 0.6 | 0.6 | 0.6 |
| Neodol 25E3S | | | | | | | | | | | 2.5 | — | — | — |
| Benzyl alcohol | — | — | — | — | — | 1.0 | — | — | — | — | — | — | — | — |
| Butyl Carbitol | 3.0 | — | 7.0 | — | 3.0 | — | — | 2.0 | — | — | — | — | — | — |
| ETHD | 2.5 | — | — | 6.0 | — | — | 2.0 | 3.0 | — | 2.0 | — | — | — | — |
| BPP | — | 6.0 | 3.0 | — | 7.0 | 4.0 | 2.0 | — | 6.0 | 2.0 | 6.5 | 6.0 | 6.0 | 6.0 |
| Oxydiacetic acid | 4.0 | — | — | — | — | — | — | — | — | — | — | — | — | — |
| CMTA | — | 4.0 | 10.0 | — | — | — | — | — | — | — | — | — | — | — |
| CMOS | — | — | — | 4.0 | 10.0 | — | — | — | — | — | — | — | — | — |
| THFTA | — | — | — | — | — | 3.5 | — | — | — | — | — | — | 4.0 | — |
| CPTA | — | — | — | — | — | — | 3.0 | — | — | — | — | — | — | — |
| Tartaric acid | — | — | — | — | — | — | — | 3.5 | — | — | — | — | — | — |
| OBHTA | — | — | — | — | — | — | — | — | 4.0 | — | — | — | — | — |
| Mellitic acid | | | | | | | | | | 3.5 | — | — | — | — |
| TSA/TDSA | — | — | — | — | — | — | — | — | — | — | 3.0 | 3.0 | — | |
| ODS | — | — | — | — | — | — | — | — | — | — | — | — | — | 3.0 |
| $Na_2CO_3$ | 1.0 | 1.0 | 3.5 | 1.0 | 3.5 | 1.5 | 1.5 | 1.0 | 1.0 | 1.5 | 1.0 | 1.0 | 1.0 | 1.0 |
| NaCS | 2.0 | 2.5 | 8.0 | 1.5 | 8.0 | 2.5 | 2.5 | 2.0 | 2.5 | 2.5 | 2.0 | 2.0 | 2.5 | 2.5 |
| water & minors | | | | | | | UP TO 100 | | | | | | | |

The following creamy scouring compositions according to the invention are also prepared:

| | Ex XV | Ex XVI | Ex XVII | Ex XVIII | Ex XIX | Ex XX |
|---|---|---|---|---|---|---|
| LAS | — | 0.6 | 4.0 | 0.6 | 0.6 | 4.0 |
| NaPS | 4.0 | 3.0 | — | 3.0 | 3.0 | — |
| Lutensol AO7 | — | 0.3 | — | 0.3 | 0.3 | — |
| HCnFA | 2.0 | 0.6 | 1.5 | 0.4 | 0.5 | 1.5 |
| Benzyl alcohol | 1.0 | 1.3 | — | 1.3 | 1.3 | — |
| BPP | 3.0 | 2.0 | 4.0 | 2.0 | 2.0 | 4.0 |
| CMTA | 3.0 | 3.0 | — | — | — | — |
| CMOS | — | — | 3.0 | — | — | — |
| THFTA | — | — | — | 3.0 | — | — |
| TSA/TDSA | — | — | — | — | 3.0 | — |
| ODS | — | — | — | — | — | 3.0 |
| $Na_2CO_3$ | 3.0 | 3.0 | 3.0 | 3.0 | 3.0 | 3.0 |
| $CaCO_3$ | 30.0 | 30.0 | — | 30.0 | 30.0 | — |
| Polyvinylchloride | — | — | 10.0 | — | — | 10.0 |
| Sokolan ® PHC25 | 0.4 | 0.6 | 0.4 | 0.6 | 0.6 | 0.4 |

The compositions prepared in accordance with Examples I to XX show very good performance in terms of kitchen and bathroom soil removal from hard surfaces, especially calcium soap soil removal from bathtub surfaces.

A composition containing isopropanol as solvent and CMTA as builder, was found to be less efficient in terms of soil-removal properties, thus showing the criticality of the boiling point parameter used to select the solvents useful herein.

We claim:

1. A method for cleaning a hard surface which comprises applying thereto a hard surface cleaning composition containing from 1% to 20% of organic solvent having a boiling point above 90° C., said solvent consisting of solvent selected from the group of glycol ethers and diols having 6 to 16 carbon atoms in their molecular structure and from 1% to 20% of chelating agent consisting essentially of agent selected from the group consisting of carboxymethyltartronic acid, tetrahydrofurantetracarboxylic acid, combinations of tartrate monosuccinic acid and tartrate disuccinic acid, oxydisuccinic acid, and mixtures thereof or their alkali metal salts, the ratio of said organic solvent to said chelating agent being from 2:3 to 2:1.

2. A method in accordance with claim 1 wherein the chelating agent is carboxymethyltartronic acid or its alkali metal salt.

3. A method in accordance with claim 1 wherein the chelating agent is oxudisuccinic acid or its alkali metal salt.

4. A method in accordance with claim 1 wherein the chelating agent is a combination of tartrate monosuccinic acid and tartrate disuccinic acid or their alkali metal salts.

5. A method in accordance with claim 4 where the weight ratio of tartrate monosuccinic acid to tartrate disuccinic acid is 70:30 to 90:10.

6. A method in accordance with claim 1 wherein the chelating agent is tetrahydrofurantetracarboxylic acid or its alkali metal salt.

7. A method in accordance with claim 1 wherein the organic solvent is selected from glycol ethers having 6 to 16 carbon atoms in their molecular structure.

8. A method in accordance with claim 1 wherein the organic solvent is selected from the group consisting of butoxypropanol, 1-(2-butoxy-1-methylethoxy)propanol, 2,2,4-trimethyl-1,3-pentanediol.

9. A method in accordance with claim 8 wherein the organic solvent is 1-(2-butoxy-1-methylethoxy)-propanol.

10. A method in accordance with claim 1 wherein the composition additionally contains an abrasive.

* * * * *